US006138531A

United States Patent [19]

Lamons

[11] Patent Number: 6,138,531

[45] Date of Patent: Oct. 31, 2000

[54] HAND RATCHET WRENCH

[76] Inventor: Dan E. Lamons, 2500 Rossville Blvd., Chattanooga, Tenn. 37408

[21] Appl. No.: 09/028,089

[22] Filed: Feb. 23, 1998

[51] Int. Cl.[7] ..... B25B 13/46

[52] U.S. Cl. ..... 81/60; 81/58.1; 81/63.1; D8/25

[58] Field of Search ..... 81/58, 58.1, 59.1, 81/60, 61, 62, 63, 63.1, 63.2, 121.1, 125, 177.1, 177.2, 177.85, 180.1, 489, 492; D8/25

[56] References Cited

U.S. PATENT DOCUMENTS

| | | | |
|---|---|---|---|
| D. 255,979 | 7/1980 | Boursaw | D8/25 |
| D. 271,937 | 12/1983 | Combs | D8/25 |
| D. 292,771 | 11/1987 | Kim | D8/25 |
| D. 337,246 | 7/1993 | Arden | D8/25 |
| D. 359,211 | 6/1995 | Knox et al. | D8/25 |
| D. 371,298 | 7/1996 | Reddy et al. | D8/25 |
| 2,621,688 | 12/1952 | Wales . | |
| 2,672,066 | 3/1954 | Sandrock . | |
| 2,697,370 | 12/1954 | Brooks . | |
| 2,982,160 | 5/1961 | Little . | |
| 3,508,455 | 4/1970 | Miller . | |
| 3,656,376 | 4/1972 | Campbell et al. . | |
| 3,691,876 | 9/1972 | Cassidy, Jr. | 81/58.1 |
| 3,762,245 | 10/1973 | Smyers et al. | 81/177.85 |
| 3,823,624 | 7/1974 | Martin . | |
| 4,212,336 | 7/1980 | Smith . | |
| 4,541,314 | 9/1985 | Korkowski | 81/58.1 |
| 4,748,874 | 6/1988 | Sharp et al. | 81/58.1 |
| 4,791,837 | 12/1988 | Main . | |
| 4,799,407 | 1/1989 | Miyamoto . | |
| 5,005,448 | 4/1991 | Main . | |
| 5,086,673 | 2/1992 | Korty | 81/59.1 |
| 5,152,196 | 10/1992 | Garrett | 81/58.1 |
| 5,216,940 | 6/1993 | Hedden | 81/177.2 |
| 5,461,950 | 10/1995 | Iwinski | 81/61 |

FOREIGN PATENT DOCUMENTS

| | | | |
|---|---|---|---|
| 894363 | 4/1962 | United Kingdom | 81/177.1 |

*Primary Examiner*—David A. Scherbel
*Assistant Examiner*—Joni B. Danganan
*Attorney, Agent, or Firm*—Miller & Martin LLP

[57] ABSTRACT

A hand ratchet wrench with opposed parallel sides permits utilization of a fixed jaw or adjustable wrench for driving difficult work pieces. In addition, the hand ratchet is provided with a mechanism that permits quick release from socket bits and reversal of the ratcheting mechanism. Finally, an optional hand piece is provided which engages the hand ratchet with detents, to facilitate use of the hand ratchet as a speed wrench.

20 Claims, 1 Drawing Sheet

HAND RATCHET WRENCH

BACKGROUND OF THE INVENTION

The present invention relates to an improved tool primarily intended for use as a complement to an adjustable wrench. A hand ratchet according to the present invention is conveniently utilized with socket sets and typical socket wrench attachments to rotatably drive a work piece utilizing the mechanical leverage from a wrench. Optionally, the hand ratchet may be rotated by hand alone or with the assistance of a hand grip.

Numerous tools have been developed in the past to rotatably drive work pieces such as screws, bolts, nuts, and the like. Those prior art tools include common screwdrivers, wrenches, adjustable wrenches, and socket wrenches. Of particular interest to the present invention are both adjustable wrenches and socket wrenches. Adjustable wrenches have long been a staple tool of mechanics, and many variations have been patented including U.S. Pat. Nos. 1,144,793 and 2,722,150. Indeed, the very popularity of adjustable wrenches lead to the development of the Multi-tool Adjustable Wrench described in commonly owned U.S. Pat. No. 5,345,636. Although the Multi-tool Adjustable Wrench permits a mechanic to carry only a single tool to accomplish many tasks, additional tools are required for driving work pieces, particularly in confined spaces.

Socket wrenches are of particular interest because of their usefulness in driving work pieces in confined spaces. A socket wrench typically consists of a handle with a ratchet mechanism and coupling drive member located at one end. A bit selected from a set of sockets referred to herein as socket bits, having various work ends; i.e., openings sized to receive commonly dimensioned work pieces, such as bolt heads or nuts, is removably mounted on the coupling drive member and used to loosen or tighten a particular work piece. The ratchet handle of a socket wrench set has no other purpose than to drive socket bits. Accordingly, there is a benefit to eliminating the necessity for the ratchet handle which will typically be about 8 inches long, and instead replacing it with a hand ratchet mechanism.

A hand ratchet mechanism according to the present invention is adapted to permit its use as a speed wrench by hand or in connection with an optional hand grip. Furthermore, the hand ratchet mechanism of the present invention is designed to be rotatably driven with substantial torque by an adjustable wrench or properly sized fixed jaw wrench.

SUMMARY OF THE INVENTION

It is the object of the invention to provide a new and useful improvement for the rotation of work pieces, that can be used in conjunction with an adjustable wrench or fixed jaw wrench.

It is another object of the invention to provide a hand ratchet for the rotation of work pieces either with or without an optional hand grip accessory.

It is yet another object of the invention to provide a hand ratchet of minimal size that can be used with an auxiliary tool to gain mechanical advantage during rotation of a work piece.

It is an additional object of the invention to provide a hand ratchet that can be utilized with existing socket bits and which is simple and inexpensive to manufacture.

It is a further object of the invention to provide a hand ratchet that can be turned by an auxiliary tool with less torque being applied to the hand ratchet than prior art devices.

The preferred embodiment of the invention has a standard ratchet mechanism inserted within a bolt shaped (hexagonal) casing with a male socket shank extending below and both a quick release and reversible mechanism accessible from the top. The hand ratchet may be turned by hand, by fitting an optional hand grip over the casing, or by engaging the casing with an adjustable or fixed jaw wrench. These and other objects of the invention will become apparent from consideration of the following detailed description and accompanying drawings.

DETAILED DESCRIPTION OF THE INVENTION

Figure 1:
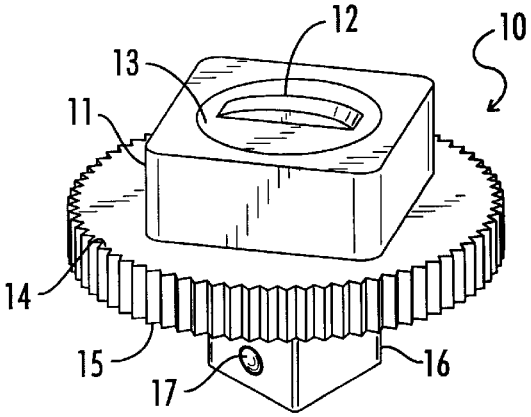
FIG. 1 is a perspective view of a four sided embodiment of the invention with a speed wheel.
Figure 2:
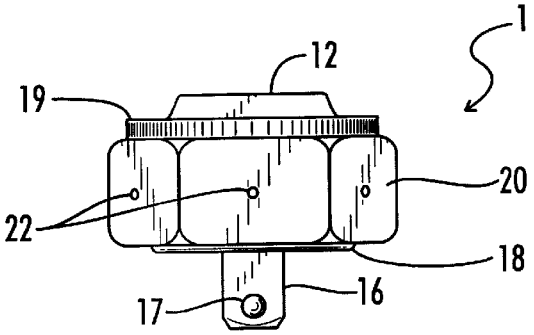
FIG. 2 is a side plan view of a hexagonal embodiment of the invention.

Turning first to FIG. 1, a four-sided embodiment of a hand ratchet 10 according to the present invention is shown. This invention consists of a standard reversible ratchet mechanism contained within rectangular case 11. Protruding from case 11 is switch 12 mounted on disk 13. Also shown is larger turning wheel 14 with serrations 15 for easy gripping. Protruding from the lower side of hand ratchet 10 is drive post 16 with detent 17 which are received in coupling openings of socket bits. Depressing switch 12 with respect to case 11 is designed to relieve pressure against detent 17 and permit quick release of the hand wrench from a socket bit with which it is engaged. Alternatively, detent 17 may simply be spring loaded. When disk 13 is rotated with respect to case 11, the ratchet mechanism preferably will alternate between clockwise and counterclockwise ratcheting.

There is no requirement as to a particular ratchet mechanism employed within case 11. Ratchet and pawl mechanisms are typical, however, alternative roller-type mechanisms may also be used.

Figure 3:
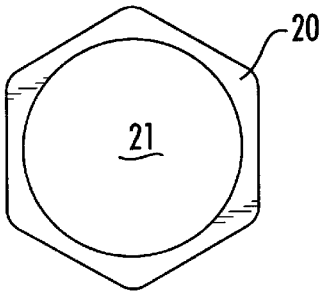
FIG. 3 is a top plan view of a hexagonal casing in which a rachet mechanism is inserted to construct the present invention.

Six-sided or hexagonal hand ratchet 1 is a preferred embodiment of the invention. Hexagonal hand ratchet 1 includes hexagonal case 20 with cavities 22 preferably uniformly located on each of its six faces. FIG. 3 illustrates case 20 in a top plan view and shows opening 21 into which ratchet mechanism is inserted. Above the ratchet mechanism is hand wheel 19 which can be held in stationary position while switch 12 is rotated left or right to allow the ratchet mechanism to turn in either a clockwise or counterclockwise direction. Retaining ring 18 holds the ratchet mechanism within case 20. Again, depressing switch 12 preferably relieves pressure against detent 17 and permits quick release for a socket bit.

Figure 4:
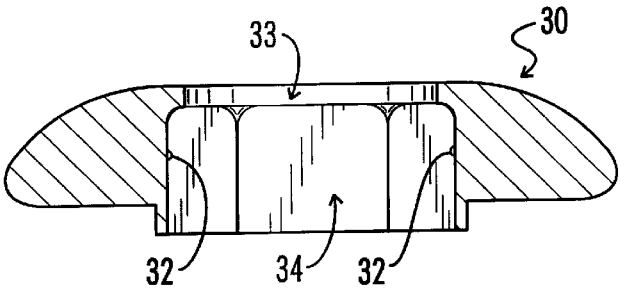
FIG. 4 is a cross-sectional view of a hand grip attachment designed for use with a hand ratchet of the present invention.
Figure 5:
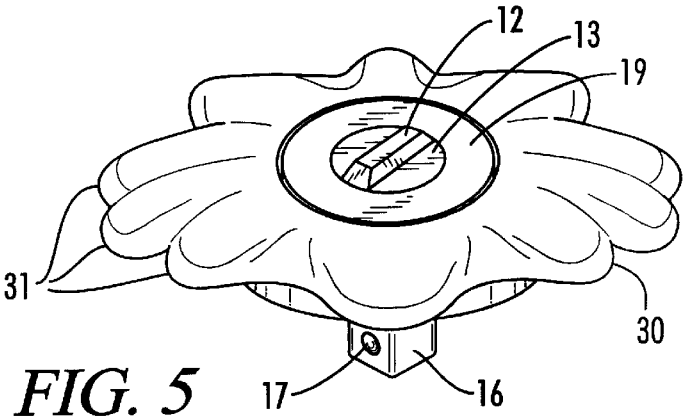
FIG. 5 is a perspective view of a hand ratchet with grip attachment according to the present invention.

FIG. 4 is a cross-sectional view of an optional hand grip attachment 30 which may be fitted over hexagonal hand ratchet 1 as shown in FIG. 5. Hand grip 30 preferably has a generally circular and easily graspable surface such as protrusions 31 to facilitate hand turning. When hand grip 30 is positioned on hexagonal hand ratchet 1, as shown in FIG.

5, hexagonal case 20 is received within hexagonal opening 34 of the grip 30 while switch 12 protrudes through aperture 33 of the grip 30 and is accessible while the hand grip is in place, both to be depressed and thereby relieve detent 17 for a quick release of hand ratchet 1 from a socket bit, or to permit toggling of ratchet direction from clockwise to counterclockwise. Preferably at least two detents 32 protrude from the interior walls defining the hexagonal cavity 34. These detents 32 can be engaged in cavities 22 on the casing 20 of the hand ratchet 1. Note that the preferred grip designs do not add additional height to the hand ratchet so that less than two inches of vertical clearance is required for operation.

In practice, a socket bit adapted to fit a particular work piece is selected and engaged with that work piece. Then the drive post 16 of hand ratchet 1 is inserted into the coupling socket of the socket bit. If the work piece may be easily rotated, then switch 12 is simply set to permit either clockwise or counterclockwise rotation as may be desired and case 20 is manually grasped and rotated in the desired direction to drive the work piece. Hand ratchet 1 and socket bit may then be separated by depressing switch 12 to relieve detent 17 and permit easy disengagement of the selected socket bit.

If the work piece is not easily driven by hand, and room permits, an optional hand piece 30 may be placed over hand ratchet 1 and utilized for extra leverage to increase the torque applied to the work piece. It will be noted that the hand grip 30 does not materially increase the overall height of the hand ratchet assembly 1 which still permits the assembly to be used in somewhat confined locations. However, in some instances, the work piece may be located too near an obstruction to permit use of the hand attachment 30, or may require additional torque, and in such case a fixed jaw or adjustable wrench may be utilized to engage casing 20 which can be turned in the same fashion as wrenches would be used to turn a nut. Furthermore, because a standard ratchet mechanism is utilized in hand ratchet 1, the entire assembly from top of switch 12 to retaining ring 18 is generally no more than about 1–1½ inches in height. The actual casing size is generally selected to be proportional with the size of the drive post 16 and wrench with which the hand wrench it would be used in the case of difficult of work pieces. For instance, a 1½-inch diameter hexagonal casing would typically be used with a ½-inch drive socket and a 12-inch adjustable wrench while a 1¼-inch hexagonal casing would be utilized with a ⅜-inch drive socket and a 10-inch adjustable wrench. The smallest standard size would typically be a 1-inch casing 20 utilized with a ¼-inch drive socket 16 and a 6-inch wrench. It will be understood that these dimensions may vary somewhat, but these are the preferred relationships to promote proper usage of the tools. If a 12-inch wrench were utilized to engage a 1-inch casing with ¼-inch drive socket, there might be a tendency to over-torque the hand ratchet and damage its components.

It will also be appreciated that when the hand grip 30 or a wrench is employed to engage casing 20, torque is being applied to a structure having a diameter of between 1–2 inches. A casing of this dimension, even with relatively thin walls, can be made quite rigid when compared even to a solid post only having a fraction of the diameter. Thus, it is anticipated that any mechanical failures would occur either with the internal ratchet mechanism or drive socket 16.

Therefore, it will be seen that the present invention permits the utilization of a full range of socket bits with hand ratchet 1 that easily serves as a reversible speed wrench. Furthermore, the entire mechanical advantage that would be available with a standard ratcheting socket wrench is available through the utilization of either an appropriately sized fixed jaw or adjustable wrench to seize parallel sides of casings 20 or 11.

Numerous alterations of the methods herein described will suggest themselves to those skilled in the art. It will be understood that the details and arrangements of the components that have been described and illustrated in order to explain the nature of the invention are not to be construed as any limitation of the invention, and all such alterations which do not depart from the spirit of invention are intended to be included within the scope of the intended claims.

I claim:

1. The combination of a wrench and a hand ratchet wrench, said hand ratchet wrench comprising:

(a) a polygonal casing having at least two opposing and substantially planar parallel exterior sides located about a central opening;

(b) a ratchet mechanism, having a top and a bottom, being received within the opening of said casing; and (c) a drive post protruding from the bottom of said ratchet mechanism;

wherein the wrench has at least two opposing and substantially planar parallel surfaces for cooperating with said at least two opposing and substantially planar parallel exterior sides of said polygonal casing of the hand ratchet wrench.

2. The hand wrench of claim 1 wherein the casing is rectangular.

3. The hand wrench of claim 1 wherein the casing is hexagonal.

4. The hand wrench of claim 1 wherein the drive post further comprises a detent.

5. The hand wrench of claim 4 wherein the ratchet mechanism further comprises a switch on the top of the ratchet mechanism to relieve pressure on the detent of the drive post.

6. The hand wrench of claim 1 wherein the ratchet mechanism is adjustable between a clockwise direction and a counterclockwise direction.

7. The hand wrench of claim 1 wherein the diameter of the casing is between about 1-inch and about 2-inches.

8. The hand wrench of claim 1 wherein the height of the polygonal casing and ratchet mechanism is less than 1.5 inches.

9. A speed wrench comprising:

(a) a hand grip having a generally circular and easily graspable outer circumference and a plurality of opposed planar interior surfaces defining a polygonal vertical opening;

(b) a polygonal casing having at least two opposing and substantially parallel planar surfaces located about a central opening and a plurality of sides releasably received within the vertical opening of the hand grip;

(c) a ratchet mechanism, having a top and a bottom, being received within the opening of the polygonal casing; and (d) a drive post protruding from the bottom of said ratchet mechanism.

10. The speed wrench of claim 9 wherein the polygonal vertical opening is rectangular.

11. The speed wrench of claim 9 wherein the polygonal vertical opening is hexagonal.

12. The speed wrench of claim 9 wherein the drive post further comprises a detent.

13. The speed wrench of claim 12 wherein the ratchet mechanism further comprises a switch on the top of the ratchet mechanism to relieve pressure on the detent of the drive post.

14. The speed wrench of claim 9 wherein the ratchet mechanism is adjustable between a clockwise direction and a counterclockwise direction.

15. The speed wrench of claim 9 wherein the diameter of the polygonal vertical opening is between about 1-inch and about 2-inches.

16. The speed wrench of claim 9 wherein the height of the hand grip with the polygonal casing and ratchet mechanism received therein is less than about 1.5-inches.

17. The speed wrench of claim 9 wherein at least one of said interior surfaces comprises a detent.

18. The speed wrench of claim 9 wherein at least one of the sides of said polygonal casing has a cavity.

19. A hand ratchet wrench comprising:

(a) a hexagonal casing of diameter between about 1-inch and about 2-inches, having six exterior vertical sides and a central opening;

(b) a ratchet mechanism adjustable between a clockwise direction and a counterclockwise direction, having a top and a bottom, being received within the central opening of said hexagonal casing;

(c) a drive post having a detent, protruding from the bottom of said ratchet mechanism; and (d) a switch on the top of the ratchet mechanism to relieve pressure on the detent of the drive post;

wherein the height of the hexagonal casing and ratchet mechanism is less than 1.5-inches.

20. The hand ratchet of claim 19 wherein a turning wheel having a diameter larger than the hexagonal casing extends from the hexagonal casing.

* * * * *